US005378159A

United States Patent [19]

Renn

[11] Patent Number: 5,378,159

[45] Date of Patent: Jan. 3, 1995

[54] ELECTRONIC APPARATUS INCLUDING A PAIR OF ASSEMBLIES HAVING A ZERO INSERTION FORCE THEREBETWEEN

[75] Inventor: Robert M. Renn, Pfafftown, N.C.

[73] Assignee: The Whitaker Corporation, Wilmington, Del.

[21] Appl. No.: 995,474

[22] Filed: Dec. 22, 1992

[51] Int. Cl.[5] ..... H01R 9/09

[52] U.S. Cl. ..... 439/59; 439/66; 439/377

[58] Field of Search ..... 439/59, 62, 66, 86, 439/91, 259, 260, 325, 377, 629, 630

[56] References Cited

U.S. PATENT DOCUMENTS

| | | | |
|---|---|---|---|
| 4,744,764 | 5/1988 | Rubenstein | 439/62 |
| 4,941,830 | 7/1990 | Tkazyik et al. | 439/59 |
| 5,020,999 | 6/1991 | Dewitt et al. | 439/377 X |
| 5,156,553 | 10/1992 | Katsumata et al. | 439/62 |
| 5,211,566 | 5/1993 | Bates et al. | 439/66 |
| 5,236,366 | 8/1993 | Deak et al. | 439/260 X |

*Primary Examiner*—Khiem Nguyen
*Attorney, Agent, or Firm*—William B. Noll

[57] ABSTRACT

A backplane connector (12) has a mother board (10) provided with a connector housing (13) receiving a daughter board (11) perpendicularly thereof. A cam bump (19) on the daughter board (11) engages an inclined camming surface (20) on the connector housing (13) on the mother board (10), thereby deflecting the daughter board (11) laterally away from a flexible electrical connector (14) in the connector housing (13) on the mother board (10). When the daughter board (11) is fully seated within the connector housing (13) on the mother board (10), the cam bump (19) is received in a cam bump recess (21) on the connector housing (13) on the mother board (10). A spring (18) on the connector housing (13) biases the daughter board (11) towards the mother board (10), thereby providing a detent action therebetween. A second embodiment applies the invention to a device (23) insertable into a computer (25).

17 Claims, 6 Drawing Sheets

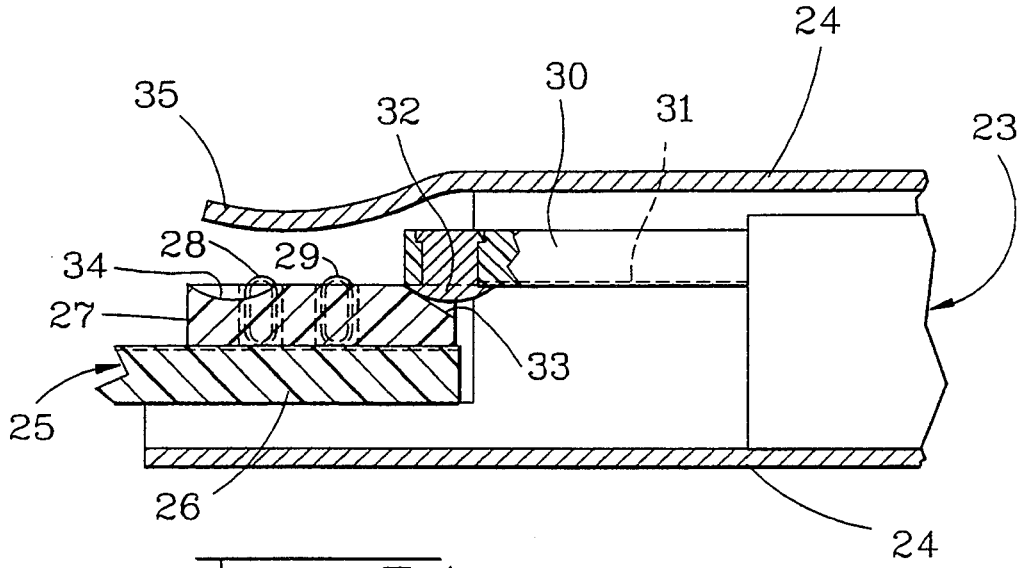
Fig. 3A
Fig. 3B
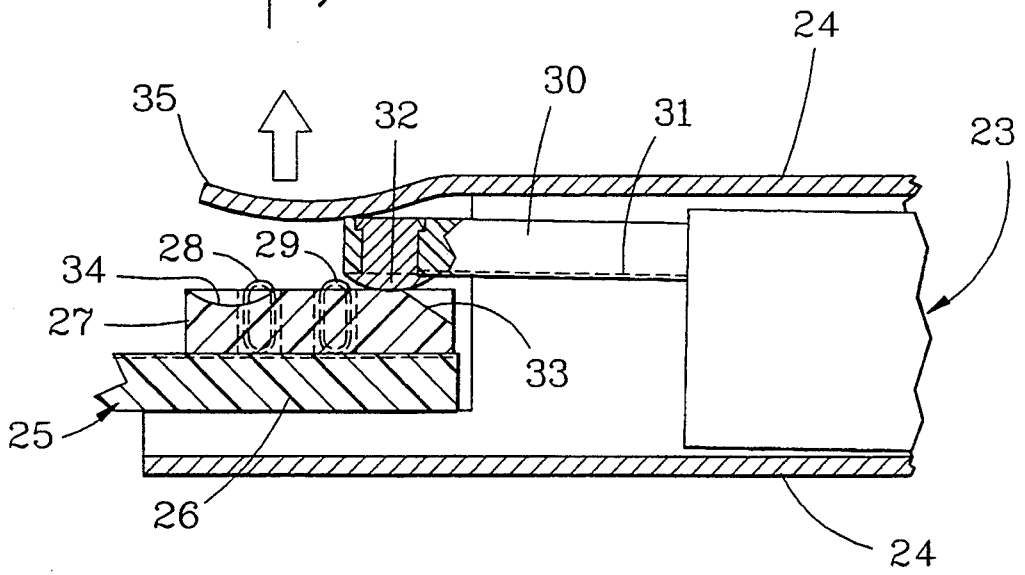

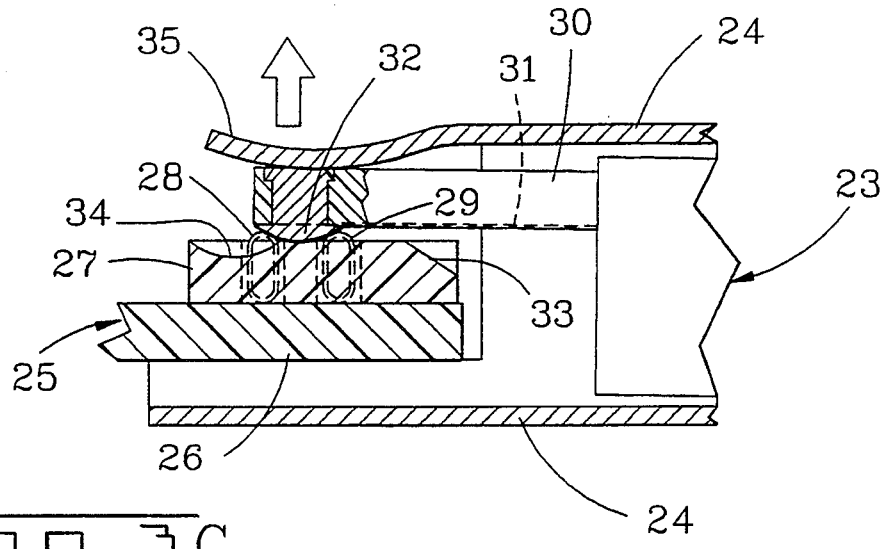
Fig. 3C
Fig. 3D
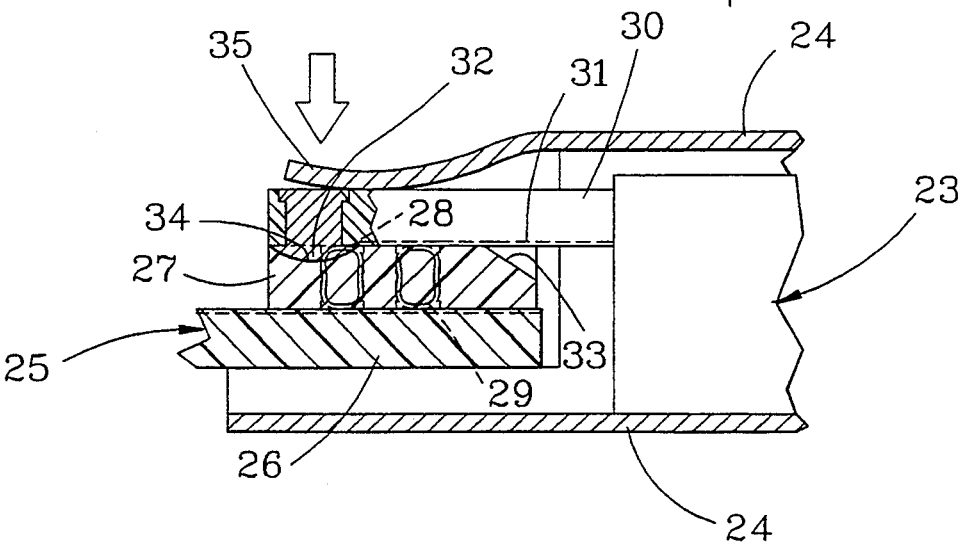

ELECTRONIC APPARATUS INCLUDING A PAIR OF ASSEMBLIES HAVING A ZERO INSERTION FORCE THEREBETWEEN

FIELD OF THE INVENTION

The present invention relates to an electronic apparatus including a pair of assemblies, one of which has at least one flexible electrical connector; and wherein the assemblies are brought together with a substantially zero insertion force, thereby precluding damage to the flexible electrical connector in the one assembly.

BACKGROUND OF THE INVENTION

Flexible electrical connectors are widely used in the electronics industry. These flexible electrical connectors comprise a plurality of closely-spaced electrical conductor elements (or traces) suitably mounted on an elastomeric core. Typically, the traces are approximately three mils wide and are on seven mils centers (four mils spacing) for relatively high circuit density in sophisticated electronic equipment for industrial and commercial markets, as well as in various consumer products. A complete line of high-quality flexible electrical connectors are marketed by AMP Incorporated of Harrisburg, Pennsylvania, under its registered trademark "AMPLIFLEX".

The flexible electrical connector (or connectors) may be suitably mounted in a connector housing and, in a typical example, the connector housing is mounted on a printed circuit board (such as a mother board) for electrical engagement with circuit elements or pads carried by a daughter board. The daughter board, for example, may be part of a computer intended to be inserted into a docking station, and the docking station may be part of a computer terminal for slidably receiving a lap-top computer.

It is important that the daughter board be received within the mother board with a substantially zero insertion force, so that the circuit elements or pads on the daughter board (or an edge of the daughter board) will not inadvertently damage the circuit traces on the flexible electrical connector on the mother board.

SUMMARY OF THE INVENTION

Accordingly, it is an object of the present invention to provide a substantially zero insertion force between a daughter board and a mother board, so that the flexible electrical connector on one of the boards is not damaged.

In accordance with the teachings of the present invention, there is herein disclosed and claimed for use in an electronic apparatus, the combination of a pair of assemblies and means for bringing the assemblies into engagement with each other. At least one flexible electrical connector is disposed on one of the assemblies, and the other assembly has at least one circuit element engaging the flexible electrical connector on the one assembly. A protrusion means on one of the assemblies engages a camming means on the other assembly, thereby deflecting the assemblies away from each other laterally of the direction in which the assemblies are brought together. As a result, the circuit element does not wipe against the flexible electrical connector, and the assemblies are brought together with a substantially zero insertion force. The other assembly has a recess means for receiving the protrusion means on the one assembly, when the assemblies are fully engaged, and resilient means are provided constantly biasing the protrusion in the recess.

In one embodiment, the one assembly comprises a mother board and the other assembly comprises a daughter board, and the daughter board is received within the mother board perpendicularly thereof in a backplane configuration. The flexible electrical connector is in a connector housing secured to the mother board, and the cooperating circuit element is carried by the daughter board.

Preferably, the protrusion means comprises a cam bump on the daughter board, and the camming means comprises a camming surface on the mother board ahead of the flexible electrical connector thereon.

In another embodiment, the apparatus comprises a computer docking system, and the one assembly comprises a docking station including a mother board having a connector housing for the flexible electrical connector. A guide housing is secured to the docking station, and the other assembly comprises a computer slidably received within the guide housing and carrying a daughter board. A leaf spring on the guide housing engages the daughter board on the computer.

Preferably, the camming means comprises a pair of spaced-apart camming surfaces on the connector housing, and the flexible electrical connector is disposed in the connector housing intermediately of the pair of spaced-apart camming surfaces. The protrusion means, in turn, comprises a pair of spaced-apart lift buttons on the daughter board, engaging the respective pair of camming surfaces on the connector housing; and the recess means comprises a pair of spaced-apart lift button pockets formed on the connector housing, beyond the respective pair of spaced-apart camming surfaces thereon, and receiving the respective pair of spaced-apart lift buttons on the daughter board.

These and other objects of the present invention will become apparent from a reading of the following specification taken in conjunction with the enclosed drawings.

BRIEF DESCRIPTION OF THE DRAWINGS

FIGS. 3A, 3B, 3C and 3D are sectional views of the embodiment of FIG. 2, where FIGS. 3A through 3D illustrate the sequence of slidably loading a guide device into a guide housing on a computer, where a lifter button on the device initially engages a camming surface, then is lifted away from the connector housing, and finally the lifter button is received in a complementary lift button pocket on the connector housing.

GENERAL DESCRIPTION OF THE PREFERRED EMBODIMENT

Figure 1A:
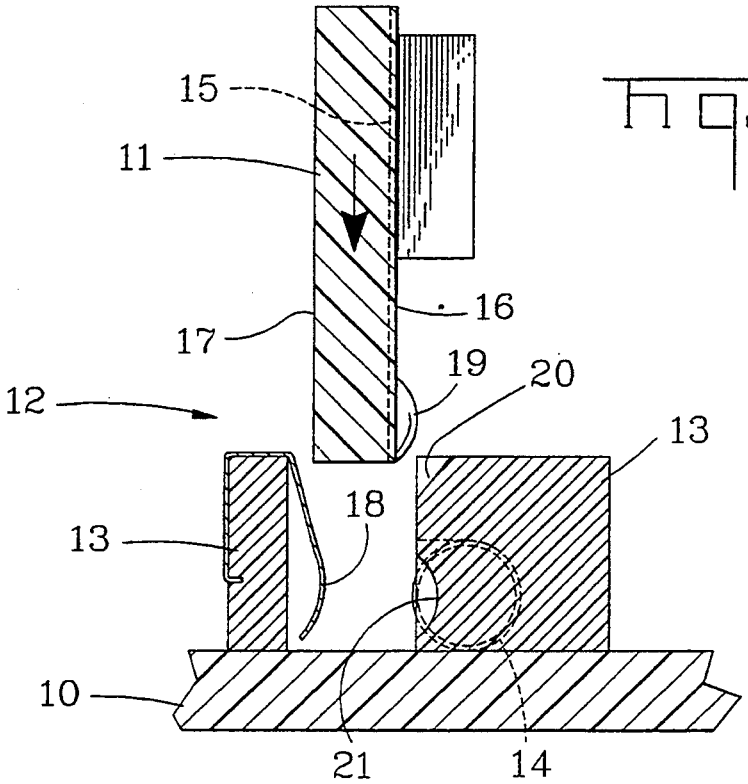
FIGS. 1A, 1B, 1C and 1D are sectional views illustrating the sequence for engaging a first embodiment of the invention for a backplane configuration, where a daughter board is initially positioned for insertion into a connector housing on a mother board, then seated into final engagement on the mother board.

With reference to FIGS. 1A–D, a mother board 10 slidably receives a daughter board 11, substantially at right angles thereto, in a backplane configuration 12 used, for example, in a personal computer. The mother board 10 has a connector housing 13 secured thereon; and at least one flexible electrical connector 14 is within the connector housing 13 for electrical engagement, ultimately, with a circuit element or pad 15 on a side 16 of the daughter board 11. The opposite side 17 of the daughter board 11 is engaged by a spring 18 mounted on the connector housing 13, thereby resiliently urging the daughter board 11 in a lateral direction towards the connector elements on the mother board 10.

Figure 1B:
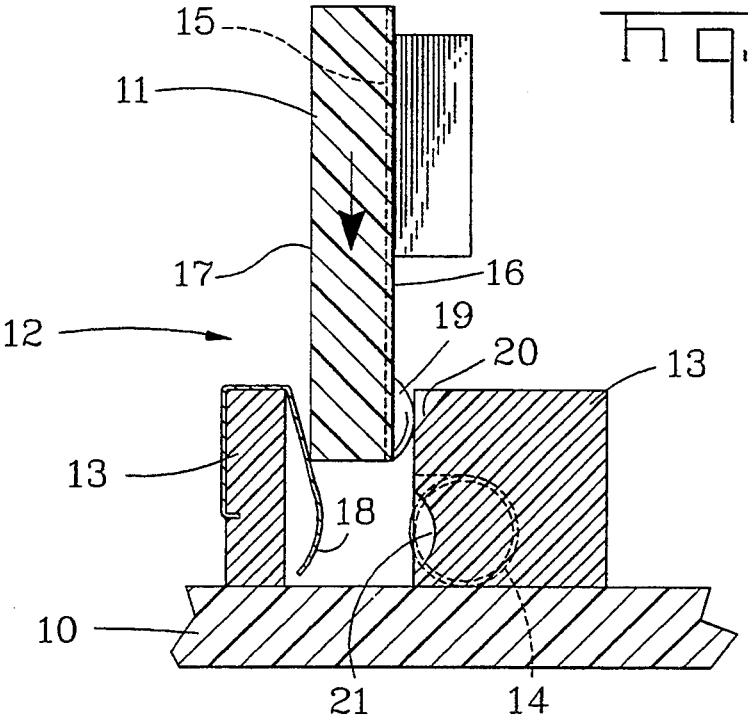
Figure 1C:
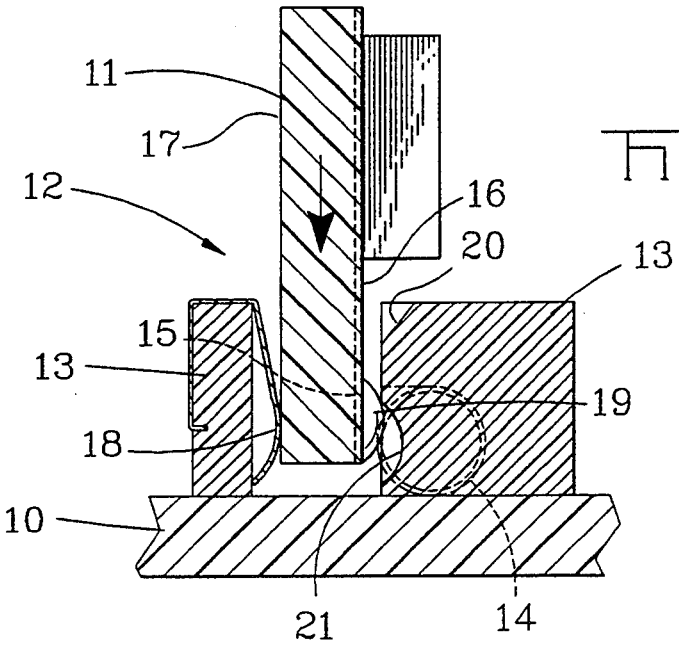

As the daughter board 11 is slidably inserted into connector housing 13 on the mother board 10, a cam bump 19 (or other protrusion means) on the daughter board 11 engages an inclined camming surface 20 (or other camming means) on the connector housing 13 on the mother board 10 (FIG. 1B).

As a result, the daughter board 11 is cammed or deflected laterally away from the flexible electrical connector 14 on the mother board 10, opposite to the resilient bias of the spring 18, and in a direction which is substantially transverse to the direction in which the daughter board 11 is slidably inserted into the connector housing 13 on the mother board 10 (as shown more clearly in FIGS. 3B and 3C).

Accordingly, the daughter board 11 and the connector housing 13 on the mother board 10 are brought together with a substantially zero insertion force (referred to in the art as "ZIF") so that the flexible electrical connector 14 is not damaged by the relative sliding movement between the circuit pad 15 on the daughter board 11 and the flexible electrical connector 14 on the mother board 10. Instead, the circuit pad (or pads) 15 come down and engage the flexible electrical connector 14 after the daughter board 11 has been fully inserted within the connector housing 13 on the mother board 10.

Figure 1D:
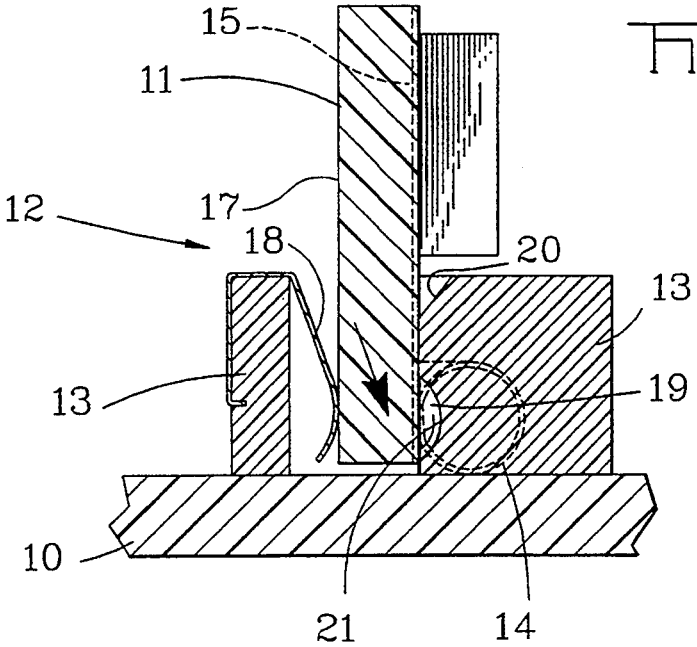
Figure 1E:
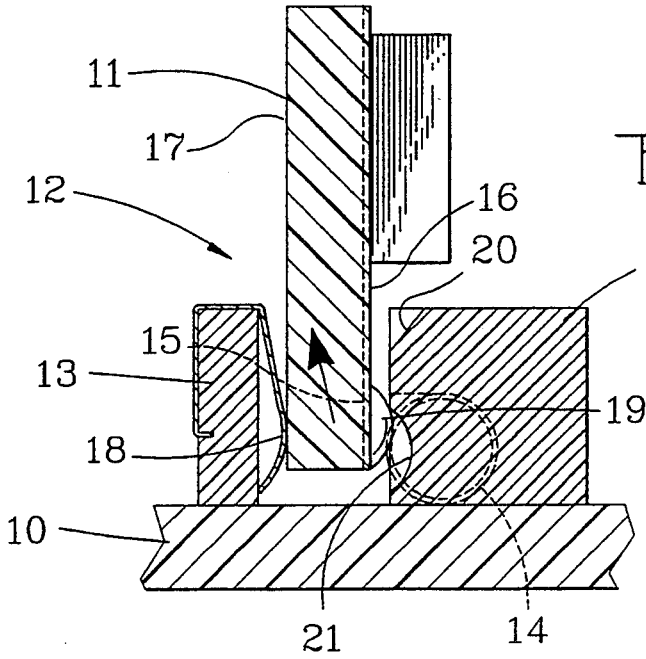
FIGS. 1E is a sectional view similar to FIGS. 1A through 1D illustrating the daughter board being lifted off the mother board, where a can bump on the daughter board engages the connector housing to deflect the daughter board laterally to free same from the connector housing.

When the daughter board 11 has been fully inserted into the connector housing 13 on the mother board 10 (as shown in FIG. 1D) the cam bump 19 is received within a cam bump recess 21 on the connector housing 13 on the mother board 10, thereby providing a detent action between the mother board 10 and the daughter board 11. This detent action is facilitated by the spring 18. However, this detent action may be overcome, manually, by lifting the daughter board 11 out of the connector housing 13 on the mother board 10, such that the cam bump 19 rides out of the its cam bump recess 21, engages the connector housing 13 on the mother board 10, and again deflects the daughter board 13 laterally thereof (as shown more clearly in FIG. 1E). Thus, for both the initial insertion of the daughter board 11 into the connector housing 13 on the mother board 10, as well as the subsequent removal of the daughter board 11 from the connector housing 13 on the mother board 10, there is a substantially zero insertion force to thereby protect the flexible electrical connector 14.

Figure 2:
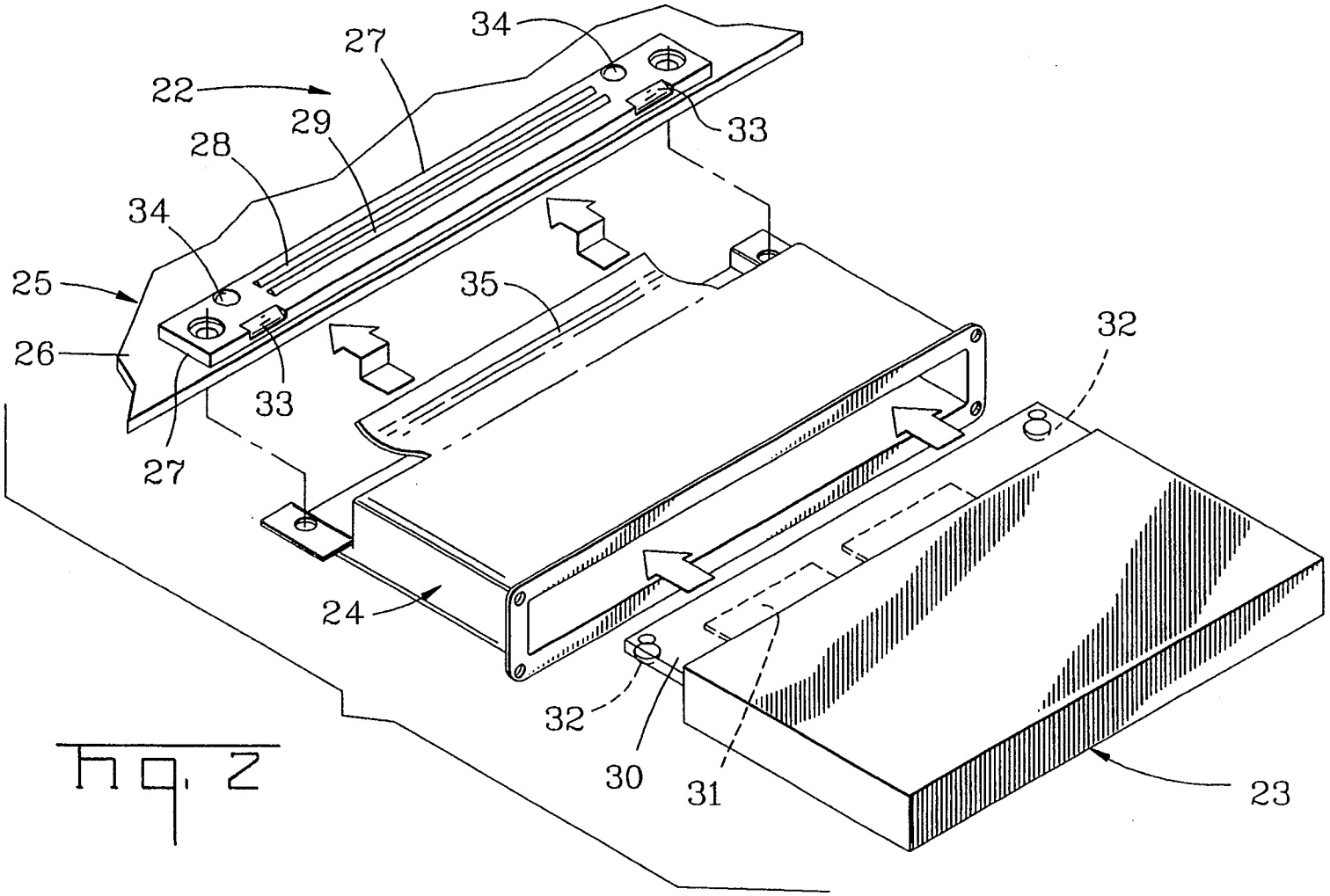
FIG. 2 is an exploded perspective view of a second embodiment of the invention, wherein a device is inserted within a guide housing on a computer. For example, the device may be a notebook or laptop computer inserted into a docking station on a mainframe computer, or the device may be an interchangeable hard disk drive inserted into a desk-top or personal computer (as shown in FIG. 2).

With reference to FIG. 2, and with further reference to FIGS. 3A–D, the invention has been applied to an apparatus 22. In this apparatus 22, a device 23 is slidably inserted into a guide housing 24 secured to a computer 25 having a mother board 26 provided with a connector housing 27. The connector housing 27, in this preferred embodiment, houses a pair of parallel flexible electrical connectors 28 and 29, respectively. The device 23, in turn, carries a daughter printed circuit board ("PCB") 30 having a plurality of circuit elements or pads 31 on the underside thereof, as shown schematically in FIG. 2.

A pair of spaced-apart lift buttons 32 on the daughter PCB 30 engages a complementary pair of spaced-apart inclined camming surfaces 33 formed on the connector housing 27 on the computer 25. Beyond these camming surfaces 33, as shown more clearly in FIG. 2, the connector housing 27 has a pair of spaced-apart lift button pockets 34 to receive, ultimately, the respective lift buttons 32 on the daughter PCB 30 on the device 23. Preferably, the flexible electrical connectors 28 and 29 are disposed on the mother board 26 intermediately of the pair of camming surfaces 33 and lift button pockets 34, respectively. The guide housing 24 has a cantilevered leaf spring 35 projecting forwardly and downwardly thereof to engage a side of the daughter PCB 30 opposite to its underside carrying the circuit pads 31.

As shown in FIG. 3A, the device 23 is slidably insertable into the computer 25 (and slidably removable therefrom). When the device 23 is slidably inserted into the guide housing 24, as shown more clearly in FIGS. 3A–B, the lift buttons 32 on the daughter PCB 30 engage the inclined camming surfaces 33 on the connector housing 27 on the mother board 26, thereby deflecting the daughter PCB 30 and lifting it upwardly away from the flexible electrical connectors 28 and 29 (as shown more clearly in FIG. 3C). Thereafter, as shown in FIG. 3D, the lift buttons 32 are received in the respective lift button pockets 34 and, preferably, with a detent action facilitated by the leaf spring 35.

The device 23 may be a notebook or laptop computer insertable into a docking station on a main frame computer. The device 23 may also be an interchangeable hard disk drive inserted into a desk-top or personal computer.

With each embodiment of the invention, a substantially zero insertion force ("ZIF") has been achieved, easily and economically, to assure product reliability and to facilitate manufacturing standardization through a modular design concept. By the same token, substantial product development and re-tooling costs have been avoided.

Obviously, many modifications may be made without departing from the basic spirit of the present invention. For example, in the FIGS. 1A–D embodiment, the cam bump 19 may be on the connector housing 13 on the mother board 10, and the inclined camming surface 20 and the cam bump recess 21 may be on the daughter board 11, if desired. Also, in the FIG. 2 embodiment, the leaf spring 35 may be on the docking station 25 instead of the guide housing 24 (again if desired). Accordingly, it will be appreciated by those skilled in the art that within the scope of the appended claims, the invention may be practiced other than has been specifically described herein.

I claim:

1. In an electronic apparatus, the combination of a pair of assemblies and means for bringing the assemblies into engagement with each other, where a first of said assemblies is mounted to a mother board, said first assembly including at least one flexible electrical connector for electrically interconnecting a circuit element on the other of said assemblies to said mother board, a protrusion means on one of the assemblies and engaging a camming means on the other assembly, thereby deflecting the assemblies away from each other laterally of the direction in which the assemblies are brought together, such that the circuit element does not wipe against the flexible electrical connector as the assemblies are brought together, and such that the assemblies are brought together with a substantially zero insertion force, the first assembly having a recess means for receiving the protrusion means on the other assembly when the assemblies are fully engaged, and resilient means constantly biasing the protrusion in the recess.

2. The combination of claim 1, wherein the one assembly comprises a mother board and the other assembly comprises a daughter board, wherein the flexible electrical connector is in a connector housing secured to the mother board, wherein the daughter board is received within the connector housing on the mother board perpendicularly thereof in a backplane configuration, and wherein the cooperating circuit element is carried by the daughter board.

3. The combination of claim 2, wherein the protrusion means comprises a camming bump on the daughter board ahead of the circuit element thereon, and wherein the camming means comprises a camming surface on the connector housing on the mother board ahead of the flexible electrical connector thereon.

4. The combination of claim 3, wherein the recess means comprises a cam bump recess.

5. The combination of claim 3, wherein the daughter board has first and second sides, the circuit element being carried on the first side, and wherein the resilient means comprises a spring on the connector housing on the mother board, the spring engaging the second side of the daughter board.

6. The combination of claim 1, wherein the one assembly comprises a computer, wherein the other assembly comprises a device insertable into the computer, and wherein the computer has the mother board and the device has the daughter board.

7. The combination of claim 6, wherein the camming means comprises a pair of spaced-apart camming surfaces on the connector housing on the mother board in the computer, and wherein the flexible electrical connector is disposed in the connector housing intermediately of the pair of spaced-apart camming surfaces.

8. The combination of claim 7, wherein the protrusion means comprises a pair of spaced-apart lift buttons on the daughter board on the device and engaging the respective pair of camming surfaces on the connector housing.

9. The combination of claim 8, wherein the recess means comprises a pair of spaced-apart pockets formed on the connector housing, beyond the respective pair of spaced-apart camming surfaces thereon, and receiving the respective pair of spaced-apart lift buttons on the daughter board.

10. In a mother board and daughter board configuration, wherein the mother board includes at least one flexible electrical connector in a connector housing, and wherein the daughter board has first and second sides, the first side carrying at least one circuit element engaging the flexible electrical connector when the daughter board is slidably received into the connector housing on the mother board, the improvement comprising a cam protrusion carried by the daughter board and engaging a camming surface formed on the connector housing on the mother board, thereby lifting the daughter board laterally away from the flexible electrical connector on the connector housing on the mother board as the daughter board is slidably received in the connector housing on the mother board, a spring engaging the second side of the daughter board, thereby exerting a resilient bias on the daughter board in opposition to the engagement between the cam protrusion on the daughter board and the camming surface on the connector housing on the mother board, and the connector housing on the mother board having a recess for receiving the cam protrusion after the circuit element on the daughter board has engaged the flexible electrical connector in the connector housing on the mother board, thereby providing therebetween an electrical connection requiring a substantially zero force upon insertion of the daughter board into the connector housing on the mother board or subsequent removal therefrom.

11. The improvement of claim 10, wherein the daughter board is slidably received into engagement with the connector housing on the mother board perpendicularly thereof.

12. The improvement of claim 10, wherein the daughter board is slidably received into engagement into the connector housing on the mother board parallel thereto.

13. The improvement of claim 12, wherein the cam protrusion comprises a lift button on the daughter board, and wherein the recess in the connector housing on the mother board comprises a lift button pocket.

14. The improvement of claim 13, wherein two lift buttons are provided for cooperation with two lift button pockets, respectively, the lift button pockets on the connector housing on the mother board being spaced apart from each other transversely to the direction in which the daughter board slidably engages the connector housing on the mother board.

15. The improvement of claim 14, wherein a pair of flexible electrical connectors are provided, parallel to each other, and intermediately of the pair of spaced-apart lift button pockets on the mother board.

16. The improvement of claim 14, wherein two spaced-apart camming surfaces are provided for the two spaced-apart lift buttons on the daughter board, and wherein the camming surfaces are formed on the connector housing on the mother board directly ahead of the respective lift button pockets.

17. The improvement of claim 16, wherein a guide housing is secured to the mother board, the guide housing slidably receiving the daughter board, and wherein the spring comprises a leaf spring formed on the guide housing.

* * * * *